US012687122B2

(12) United States Patent
Juday et al.

(10) Patent No.: US 12,687,122 B2
(45) Date of Patent: Jul. 21, 2026

(54) SYSTEM AND METHOD FOR OPERATING A LUBRICATION SYSTEM WITH MECHANICAL CONTROL

(71) Applicant: GM GLOBAL TECHNOLOGY OPERATIONS LLC, Detroit, MI (US)

(72) Inventors: Zachary Juday, West Bloomfield, MI (US); Mark R. Claywell, Birmingham, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 18/785,354

(22) Filed: Jul. 26, 2024

(65) Prior Publication Data

US 2026/0028924 A1 Jan. 29, 2026

(51) Int. Cl.

| | |
|---|---|
| ***F01M 5/00*** | (2006.01) |
| ***F01M 1/02*** | (2006.01) |
| ***F01M 1/16*** | (2006.01) |

(52) U.S. Cl.

CPC ..... *F01M 5/005* (2013.01); *F01M 1/02* (2013.01); *F01M 1/16* (2013.01); *F01M 2001/0215* (2013.01)

(58) Field of Classification Search

CPC ..... F01M 5/005; F01M 1/02; F01M 1/16
See application file for complete search history.

(56) References Cited

U.S. PATENT DOCUMENTS

| | | | | |
|---|---|---|---|---|
| 3,090,365 | A * | 5/1963 | Constantino | F01M 5/005 123/41.08 |
| 4,276,960 | A * | 7/1981 | Webb | F16N 25/02 137/115.14 |
| 5,220,892 | A * | 6/1993 | Boemer | F01M 1/20 123/196 AB |
| 8,267,830 | B2 | 9/2012 | Brown | |
| 9,829,088 | B2 * | 11/2017 | Goujet | F16H 57/0436 |
| 10,439,477 | B2 * | 10/2019 | Pinkley | H02K 9/00 |
| 10,479,343 | B2 | 11/2019 | Frait et al. | |
| 10,703,369 | B2 | 7/2020 | Hathaway et al. | |
| 11,231,103 | B2 * | 1/2022 | Staake | F16H 57/0441 |
| 11,987,113 | B2 * | 5/2024 | Hwang | H02P 29/60 |

(Continued)

FOREIGN PATENT DOCUMENTS

| | | | |
|---|---|---|---|
| DE | 102018112665 | A1 | 11/2019 |
| DE | 102019123981 | A1 | 3/2021 |

(Continued)

*Primary Examiner* — Michael A Riegelman
(74) *Attorney, Agent, or Firm* — Quinn IP Law

(57) ABSTRACT

A lubrication system includes a heat exchanger having an inlet and an outlet, a gearbox lubrication circuit fluidly connecting a gearbox between the inlet and the outlet of the heat exchanger, a stator lubrication circuit fluidly connecting a stator between the inlet and the outlet of the heat exchanger, and a rotor lubrication circuit fluidly connecting a rotor between the inlet and the outlet of the heat exchanger. The rotor lubrication circuit includes a rotor circuit mechanical valve located upstream of an inlet to the rotor and downstream of the outlet of the heat exchanger. Also, the rotor circuit mechanical valve is configured to move from a closed position to an open position when a pressure immediately upstream of the rotor circuit mechanical valve reaches a rotor circuit mechanical valve cracking pressure.

20 Claims, 7 Drawing Sheets

(56) References Cited

U.S. PATENT DOCUMENTS

| | | | | |
|---|---|---|---|---|
| 12,078,238 | B2 | 9/2024 | Nakawatari | |
| 12,098,766 | B2 * | 9/2024 | Greiter | F16H 57/0445 |
| 12,552,340 | B2 | 2/2026 | Suss et al. | |
| 2004/0050369 | A1 * | 3/2004 | Feucht | F02M 63/0225 123/502 |
| 2008/0182709 | A1 * | 7/2008 | Hart | F16H 61/0021 477/97 |
| 2015/0222162 | A1 * | 8/2015 | Pinkley | H02K 9/19 310/54 |
| 2017/0219083 | A1 * | 8/2017 | Ito | F16H 57/0423 |
| 2019/0120369 | A1 * | 4/2019 | Staake | F16H 57/045 |
| 2020/0158003 | A1 * | 5/2020 | Quix | F01P 3/02 |
| 2021/0006132 | A1 * | 1/2021 | Steinz | F16H 57/0417 |
| 2021/0010392 | A1 * | 1/2021 | Molesini | F16H 57/0479 |
| 2021/0039491 | A1 * | 2/2021 | Merz | F16H 57/04 |
| 2023/0287975 | A1 * | 9/2023 | Xie | F16H 57/0476 |
| 2024/0271693 | A1 * | 8/2024 | Gassmann | H02K 7/116 |
| 2024/0322649 | A1 * | 9/2024 | Ganakota | H02K 7/116 |
| 2024/0333101 | A1 * | 10/2024 | Kniel | H02K 9/193 |
| 2024/0348128 | A1 * | 10/2024 | Krank | F16H 57/0435 |

FOREIGN PATENT DOCUMENTS

| | | | | |
|---|---|---|---|---|
| DE | 102021208238 | A1 | 2/2023 | |
| DE | 102022210957 | A1 * | 4/2024 | F16H 57/0401 |
| DE | 102022004244 | A1 | 5/2024 | |
| DE | 102023200684 | A1 | 8/2024 | |
| WO | 0037836 | A1 | 6/2000 | |
| WO | WO-2015116496 | A1 * | 8/2015 | H02K 9/193 |

* cited by examiner

SYSTEM AND METHOD FOR OPERATING A LUBRICATION SYSTEM WITH MECHANICAL CONTROL

INTRODUCTION

Electrified powertrain systems of motor vehicles and other mobile electrical systems include an electrical system configured to energize one or more electric motors to generate motive torque. For example, an electric traction motor may be connected to the road wheels of an electric vehicle, with generated output torque being directed to the road wheels to propel the electric vehicle on a road surface. To this end, a high-voltage bus of the electric vehicle is connected to a rechargeable energy storage system ("RESS"), a principal component of which is a propulsion battery pack having an application-suitable number and configuration of electrochemical battery cells. The battery pack-to-motor connection is made through an intervening power inverter module when the electric traction motor is configured as a polyphase/alternating current ("AC") machine. To cool and lubricate portions of the drive train of the electric vehicle, a lubrication system circulates a lubricant to the various components to perform at least one of a cooling or lubricating function.

SUMMARY

A lubrication system for a vehicle. The lubrication system includes a heat exchanger having an inlet and an outlet, a gearbox lubrication circuit fluidly connecting a gearbox between the inlet and the outlet of the heat exchanger, a stator lubrication circuit fluidly connecting a stator between the inlet and the outlet of the heat exchanger, and a rotor lubrication circuit fluidly connecting a rotor between the inlet and the outlet of the heat exchanger. The rotor lubrication circuit includes a rotor circuit mechanical valve located upstream of an inlet to the rotor and downstream of the outlet of the heat exchanger. Also, the rotor circuit mechanical valve is configured to move from a closed position to an open position when a pressure immediately upstream of the rotor circuit mechanical valve reaches a rotor circuit mechanical valve cracking pressure.

In one aspect of the disclosure the rotor circuit mechanical valve includes one of a spring actuated ball valve or a spring actuated pressure relief valve.

In one aspect of the disclosure the rotor circuit mechanical valve includes an off-axis ball valve configured to move from the closed position to an open position allowing lubricant to flow to the rotor when a pressure in the rotor lubrication circuit exceeds the rotor circuit mechanical valve cracking pressure.

In one aspect of the disclosure the rotor circuit mechanical valve includes an off-axis ball valve configured to move from an open position to a closed position when a centrifugal force on a ball in the off-axis ball valve caused by rotation of the rotor is greater than the pressure immediately upstream of the rotor circuit mechanical valve.

In one aspect of the disclosure the system includes a heat exchanger bypass passage configured to bypass the inlet to the heat exchanger and form a bypass connection with the rotor lubrication circuit downstream of the outlet of the heat exchanger.

In one aspect of the disclosure the heat exchanger bypass passage includes a bypass mechanical valve upstream of the rotor circuit mechanical valve that remains in an open position until a bypass closing pressure is reached that is greater than the rotor circuit mechanical valve cracking pressure.

In one aspect of the disclosure the rotor lubrication circuit includes a floating ball valve upstream of the rotor circuit mechanical valve and the bypass connection.

In one aspect of the disclosure the heat exchanger bypass passage with the floating ball valve having a floating ball valve cracking pressure that is less than the bypass closing pressure.

In one aspect of the disclosure the gearbox lubrication circuit, the stator lubrication circuit, and the rotor lubrication circuit are connected fluidly in parallel with an auxiliary lubrication circuit between the outlet of the heat exchanger and a sump.

In one aspect of the disclosure the stator lubrication circuit includes a stator orifice having a stator lubrication circuit maximum flow rate, the gearbox lubrication circuit includes a gearbox orifice having a gearbox lubrication circuit maximum flow rate, and the rotor lubrication circuit includes a rotor orifice having a rotor lubrication circuit maximum flow rate.

In one aspect of the disclosure the rotor orifice is located downstream of the rotor circuit mechanical valve.

In one aspect of the disclosure the system includes an electrically driven pump having a variable output flowrate configured to direct lubricant from the gearbox lubrication circuit, the stator lubrication circuit, and the rotor lubrication circuit to an output of the electrically driven pump.

Disclosed herein is a method of operating a lubrication system. The method includes directing a lubricant from an outlet of a heat exchanger to a stator lubrication circuit, directing the lubricant from the outlet of the heat exchanger to a gearbox lubrication circuit, and selectively directing the lubricant to a rotor lubrication circuit. The rotor lubrication circuit includes a rotor circuit mechanical valve upstream of a rotor that is configured to block a flow of the lubricant to the rotor when a pressure of the lubricant immediately upstream of the rotor circuit mechanical valve is less than a cracking pressure of the rotor circuit mechanical valve. Also, the rotor circuit mechanical valve is configured open when the pressure of the lubricant immediately upstream of the rotor circuit mechanical valve is greater than the cracking pressure of the rotor circuit mechanical valve.

In one aspect of the disclosure the method includes directing the lubricant through the lubrication system with an electrically driven pump having variable output flowrate.

In one aspect of the disclosure the method includes bypassing lubricant around the heat exchanger with a heat exchanger bypass passage forming a connection to the rotor lubrication circuit. The heat exchanger bypass passage includes a bypass mechanical valve located upstream of the rotor circuit mechanical valve and the bypass mechanical valve includes a cracking pressure to move from an open position to a closed position that is greater than the cracking pressure of the rotor circuit mechanical valve.

In one aspect of the disclosure the method includes opening a floating ball valve located downstream of an outlet of the heat exchanger and upstream of the bypass connection with the heat exchanger bypass passage at the cracking pressure of the bypass mechanical valve.

In one aspect of the disclosure the rotor circuit mechanical valve includes one of a spring actuated ball valve or a spring actuated pressure relief valve.

In one aspect of the disclosure the rotor circuit mechanical valve includes an off-axis ball valve.

Disclosed herein is a vehicle. The vehicle includes a passenger compartment, wheels supporting the passenger compartment, a traction motor having a rotor and a stator with the rotor configured to drive at least one of the plurality of wheels through a gearbox and a lubrication circuit. The lubrication system includes a heat exchanger having an inlet and an outlet, a gearbox lubrication circuit fluidly connecting a gearbox between the inlet and the outlet of the heat exchanger, a stator lubrication circuit fluidly connecting a stator between the inlet and the outlet of the heat exchanger, and a rotor lubrication circuit fluidly connecting a rotor between the inlet and the outlet of the heat exchanger. The rotor lubrication circuit includes a rotor circuit mechanical valve located upstream of an inlet to the rotor and downstream of the outlet of the heat exchanger. Also, the rotor circuit mechanical valve is configured to move from a closed position to an open position when a pressure immediately upstream of the rotor circuit mechanical valve reaches a rotor circuit mechanical valve cracking pressure.

In one aspect of the disclosure, the vehicle includes a heat exchanger bypass passage configured to bypass the inlet to the heat exchanger and connect with the rotor lubrication circuit downstream of the outlet of the heat exchanger, wherein the heat exchanger bypass passage includes a bypass mechanical valve upstream of the rotor circuit mechanical valve and the bypass mechanical valve includes a cracking pressure to move from an open position to a closed position that is greater than the cracking pressure of the rotor circuit mechanical valve.

The appended drawings are not necessarily to scale and may present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

Those having ordinary skill in the art will recognize that terms such as "above," "below", "upward", "downward", "top", "bottom", "left", "right", etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may include a number of hardware, software, and/or firmware components configured to perform the specified functions.

Figure 1:
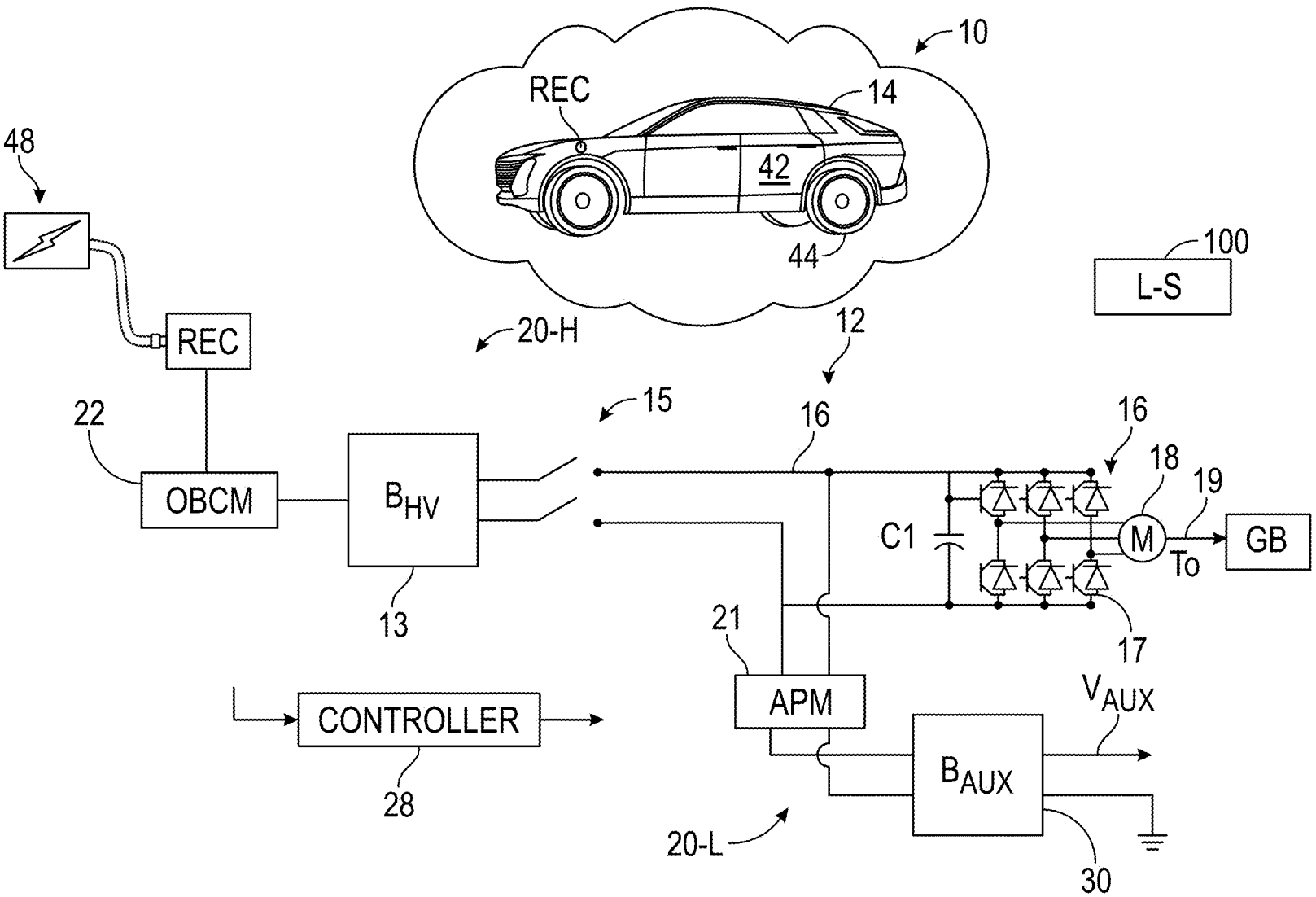
FIG. 1 is a schematic illustration of an example vehicle having an electric drivetrain.

Referring to the drawings, like reference numerals correspond to like or similar components throughout the several Figures. FIG. 1 illustrates an electrical system 12, e.g., an electrified powertrain system of a motor vehicle 10 having a vehicle body 14 defining a vehicle interior 42 or passenger compartment. The motor vehicle 10 of FIG. 1 includes a charging receptacle REC in communication with the electrical system 12. The motor vehicle 10 also includes road wheels 44 for traveling along roadways. The wheels 44 may be driven/powered through the electrical system 12 or undriven/freewheeling, as described in greater detail below.

The electrical system 12 includes separate high-voltage and low-voltage buses. The high-voltage bus 20-H is in electrical communication with a high-voltage battery pack assembly 13, such as a traction battery, and the low-voltage bus 20-L is in electrical communication with an auxiliary battery ("$B_{AUX}$") 30. At least on-board charging module ("OBCM") 22—include inputs in communication with the charging receptacle REC as power converters to convert an AC power source from a charge station 48 to DC power at an outlet to charge the battery pack assembly 13. At least one auxiliary power module ("APM") 21 isolate the high-voltage bus 20-H from the low-voltage bus 20-L with input in communication with the high-voltage bus 20-H and outputs in communication with the low-voltage bus 20-L to charge the auxiliary battery 30 and power vehicle accessories, such as heated seats, power windows, or navigation systems. The OBCM 22 and APM 21 are both in communication with an electronic controller 28 in the electrical system 12.

The electronic controller 28 may include a computer and/or processor, and include software, hardware, memory, algorithms, connections, etc., for managing and controlling the operation of the motor vehicle 10. As such, a method, described below and generally represented in FIG. 5, may be embodied as a program or algorithm partially operable on the controller 28. It should be appreciated that the controller 28 may include a device capable of analyzing data from the sensors, comparing data, making the decisions required to control the operation of the motor vehicle 10, and executing the required tasks to control the operation of the motor vehicle 10.

The controller 28 may be embodied as one or multiple digital computers or host machines each having one or more processors, read only memory (ROM), random access memory (RAM), electrically-programmable read only memory (EPROM), optical drives, magnetic drives, etc., a high-speed clock, analog-to-digital (A/D) circuitry, digital-to-analog (D/A) circuitry, and input/output (I/O) circuitry, I/O devices, and communication interfaces, as well as signal conditioning and buffer electronics. The computer-readable memory may include non-transitory/tangible medium which participates in providing data or computer-readable instructions. Memory may be non-volatile or volatile. Non-volatile media may include, for example, optical or magnetic disks and other persistent memory. Example volatile media may include dynamic random-access memory (DRAM), which may constitute a main memory. Other examples of embodiments for memory include a flexible disk, hard disk, magnetic tape or other magnetic medium, a CD-ROM, DVD, and/or other optical medium, as well as other possible memory devices such as flash memory.

The controller 28 includes a tangible, non-transitory memory on which computer-executable instructions, including one or more algorithms, are recorded for regulating operation of the motor vehicle 10. The subject algorithm(s) may specifically include an algorithm configured to optimize energy usage of the motor vehicle 10.

Further, concerning the representative electrical system 12 of FIG. 1, the electrical system 12 is characterized by its separate high-voltage and low-voltage buses which are respectively labeled "20-H" and "20-L". For embodiments in which the electrical system 12 is part of the motor vehicle 10, e.g., an electric vehicle constructed as a battery electric vehicle, a hybrid electric vehicle, or an extended-range electric vehicle, the term "high-voltage" may encompass battery voltage capabilities of about 300 volts (V) or more. Such voltage levels are suitable for generating motive torque for vehicular propulsion functions and for powering various high-voltage accessories aboard the motor vehicle 10. The term "low-voltage" for its part refers to auxiliary voltage levels, typically 12-50V. Low-voltage conductors (not shown) thus connect the low-voltage bus 20-L to one or more low-voltage accessories located aboard the motor vehicle 10, including but not limited to lights, radios, infotainment screens, sensors, etc.

In the exemplary embodiment of FIG. 1, the battery pack assembly 13 is selectively connected to and disconnected from a load by a set of high-voltage contactors 15. The applied load in the illustrated configuration includes a DC link capacitor (C1), a power inverter module ("inverter") 16 having a plurality of semiconductor switches 17 connected to an electric traction motor ("M") 18. As appreciated in the art, inverters such as the inverter 16 shown in FIG. 1 utilize multiple dies of the semiconductor switches 17 as fast-responding ON/OFF switching devices, e.g., insulated gate bipolar transistors ("IGBTs"), metal oxide semiconductor field-effect transistors ("MOSFETs"), thyristors, etc. In a typical three-phase configuration of the electric traction motor 18, the semiconductor switches 17 are turned ON or OFF at predetermined switching intervals to output an alternating current ("AC") waveform to the electric traction motor 18.

The electric traction motor 18 shown in FIG. 1 is connected to a rotatable output member 19, such as a motor shaft and connected to a gearbox for driving the wheels 44. During drive modes, the inverter 16 is controlled with pulse width modulation ("PWM") or another application-suitable switching control technique to energize phase windings of the electric traction motor 18. As depicted, the electric traction motor 18 is a polyphase AC motor, in this instance exemplified as a three-phase machine. Rotation of the output member 19 ultimately transfers torque (To) to a coupled load, including one or more road wheels 44 of the motor vehicle 10.

Figure 2:
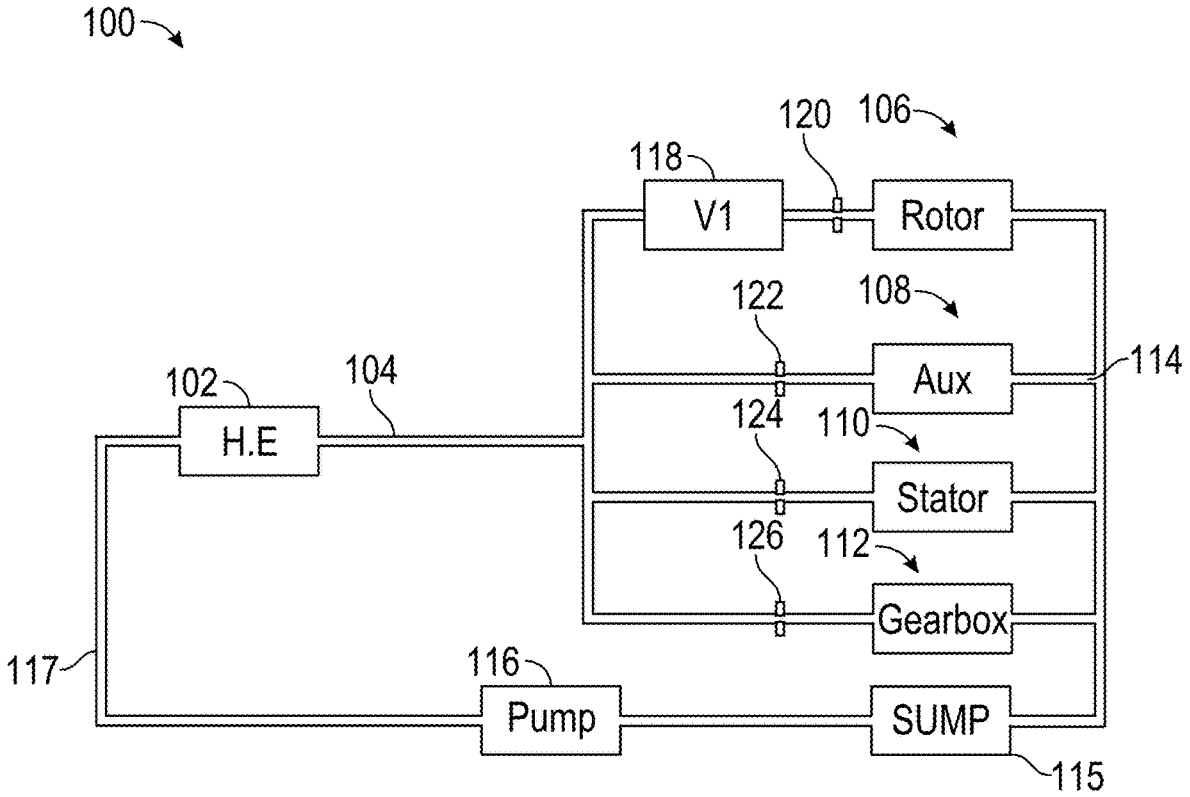
FIG. 2 is a schematic illustration of an example lubrication system for the vehicle of FIG. 1 having multiple lubrication circuits.

FIG. 2 illustrates an example lubrication system 100. In the illustrated example, the lubrication system 100 includes a fluid outlet 104 that delivers a cooled lubricant to a rotor lubrication circuit 106 for the rotor of the motor M, an auxiliary lubrication circuit 108 provides cooled lubricant to auxiliary components within the drive unit d or the battery pack assembly 13, a stator lubrication circuit 110 of the motor M, or a gearbox lubrication circuit 112 through a respective rotor lubrication circuit, auxiliary lubrication circuit, stator lubrication circuit, or gearbox lubrication circuit. A pump 116 circulates the lubricant from a sump 115 that collects the lubricant from an exhaust 114 of each of the lubrication circuits having a lower pressure than an inlet 117 to the heat exchanger 102 from the pump 116. In the illustrated example, the pump 116 can include a mechanically driven pump or an electrically driven pump having a variable output flowrate. One feature of having the electrically driven pump is that the flowrate of the lubricant can be controlled independently of a rotational output of the motor M.

In the illustrated example, the auxiliary lubrication circuit, the stator lubrication circuit, and the gearbox lubrication circuit are passively managed with an auxiliary lubrication circuit orifice 122, a stator lubrication circuit orifice 124, and a gearbox lubrication circuit orifice 126, respectively. Each of the orifices 122, 124, and 126 can include a predetermined maximum flowrate that is at least partially defined by a diameter of the orifices 122, 124, and 126. Furthermore, each of the orifices 122, 124, and 126 may result in different maximum flow rates for each of the circuit.

Furthermore, while the rotor lubrication circuit also includes a rotor lubrication circuit orifice 120, the rotor lubrication circuit also includes a rotor circuit mechanical valve, such as a first valve assembly 118. In the illustrated example, the first valve assembly 118 is mechanically actuated based on conditions of the lubrication system 100, such that it does not include an electrical actuator.

Figure 3:
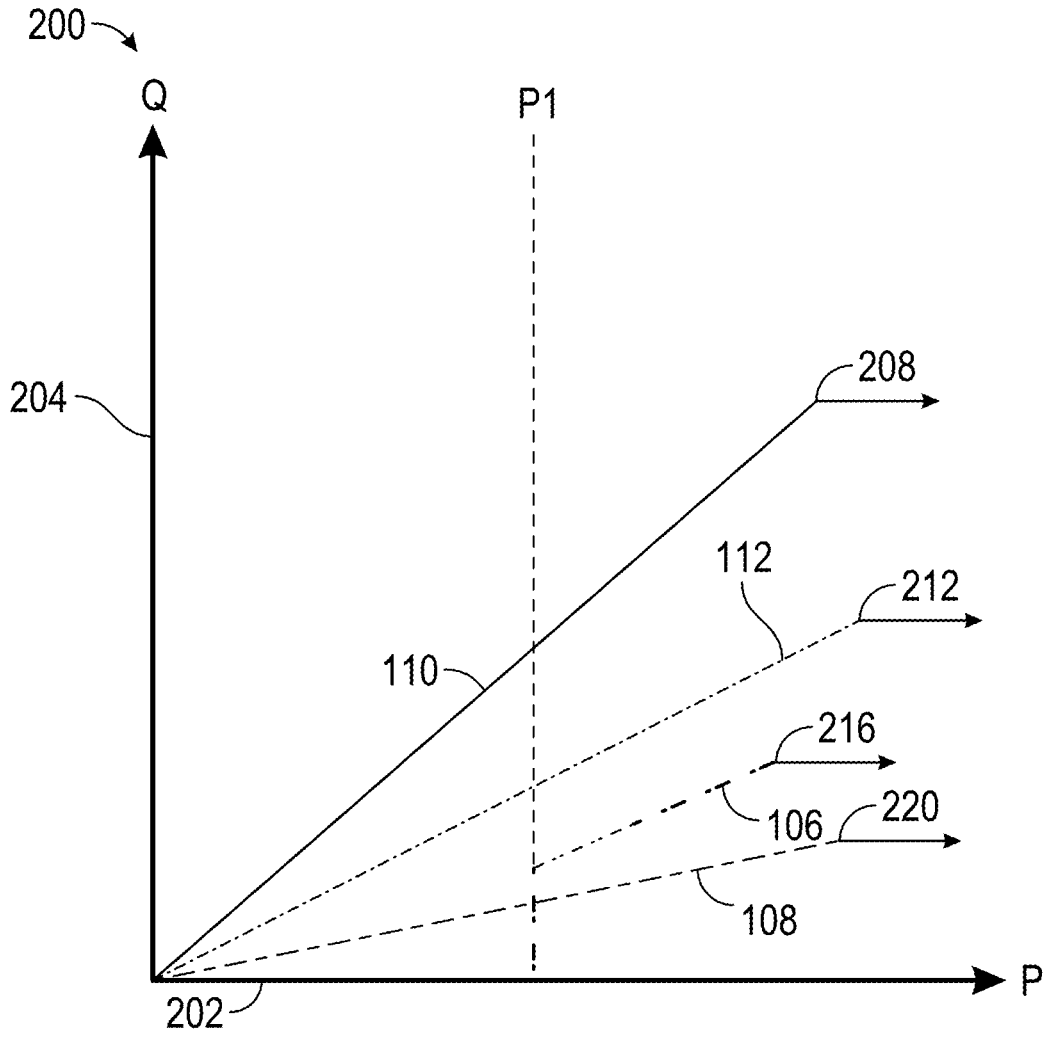
FIG. 3 is a graphical illustration of lubrication flow rates in each of the lubrication circuits of FIG. 2 at varying levels of pressure in the lubrication system.

FIG. 3 is a graphical illustration 200 showing how the flow rate ("Q") along the y-axis 204 varies for each circuit as pressure ("P") along the x-axis 202 at the outlet of the heat exchanger 102 varies. For the stator lubrication circuit 110, the flowrate Q increases with pressure P until a point 208 where a maximum flowrate determined by the stator lubrication circuit orifice 124 is reached. For the gearbox lubrication circuit 112, the flowrate Q increases with pressure P until a point 212 where a maximum flowrate determined by the gearbox lubrication circuit orifice 126 is reached. For the auxiliary lubrication circuit 108, the flowrate increases Q with pressure P until a point 220 where a maximum flowrate determined by the auxiliary lubrication circuit orifice 122 is reached.

Unlike the other lubrication circuits, the rotor lubrication circuit 106 restricts the flowrate Q of lubricant until a pressure P1 at the outlet of the heat exchanger or immediately upstream of the first valve assembly 118 is reached. In the illustrated example, the pressure P1 corresponds to the cracking pressure of the first valve assembly 118, such as a rotor circuit mechanical valve cracking pressure. One feature of restricting the flowrate Q in the rotor lubrication circuit 106 below the pressure P1, is that a rotor core temperature is allowed to increase while the pressure at the outlet of the heat exchanger 102 is below the pressure P1. The load and speed of the motor M can be used as inputs to the controller 28 to determine a speed to operate the pump 116 when it is electrically driven. This controls a pressure in the lubrication system 100 to determine when the first valve assembly 118 opens and closes.

The increase in temperature of the rotor core can increase efficiency of the motor M when the load is below a predetermined load threshold and a rotational speed of the motor M is above a predetermined rotational threshold. As shown in FIG. 3, the first valve assembly 118 restricts the flowrate Q of lubricant into the rotor lubrication circuit 106 until the pressure P1 is reached. Once the pressure P1 at the outlet of the heat exchanger 102 is reached, the flowrate Q increases until a point 216 where a maximum flowrate Q determined by the rotor lubrication circuit orifice 120 is reached.

Figure 4:
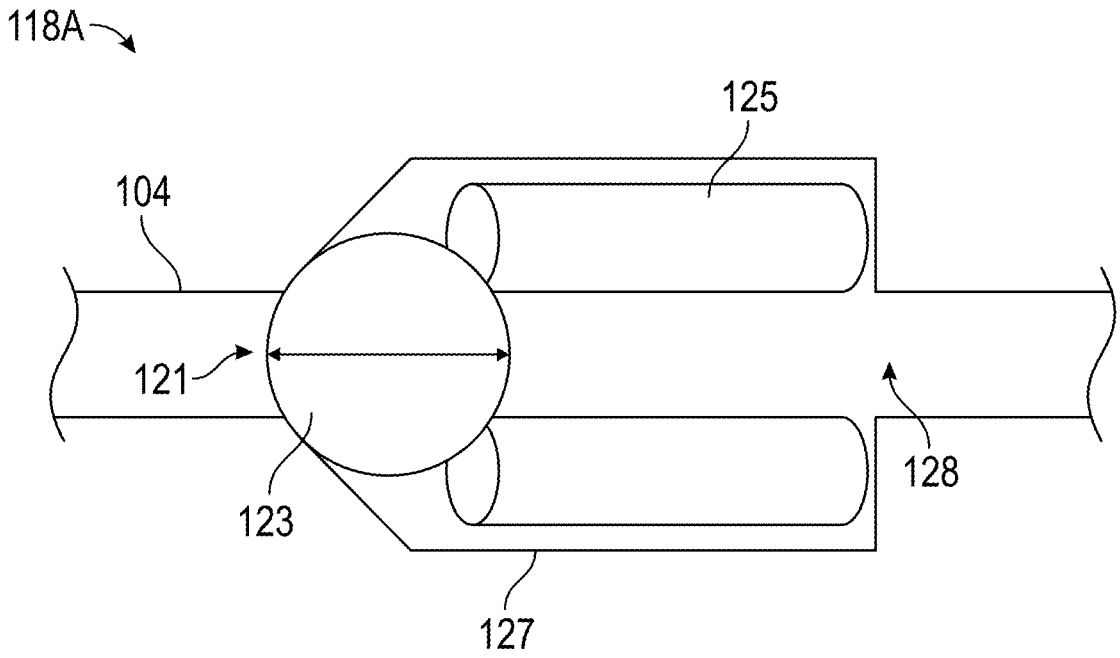
FIG. 4 is a schematic illustration of an example first valve assembly of FIG. 2.

FIG. 4 is a schematic illustration of a first valve type 118A for use as the first valve assembly 118. In the illustrated example, the first valve type 118A includes a spring actuated ball valve. The first valve type 118A includes a body portion 127 at least partially defining an inlet 121 in fluid communication with the outlet 104 of the heat exchanger 102. A ball 123 is movable in the direction of the arrows and is biased towards the inlet 121 with a spring 125. The spring 125 is configured to maintain the ball 123 seated against the inlet 121 until a pressure in the outlet 104 of the heat exchanger 102 is greater than or equal to a pressure P1. As shown in FIG. 3, once the pressure P1 is reached at the outlet 104 of the heat exchanger 102, the ball 123 moves along a direction of the arrows to an open position to allow for a flowrate Q to pass through an outlet 128 to the rotor lubrication circuit 106.

Figure 5:
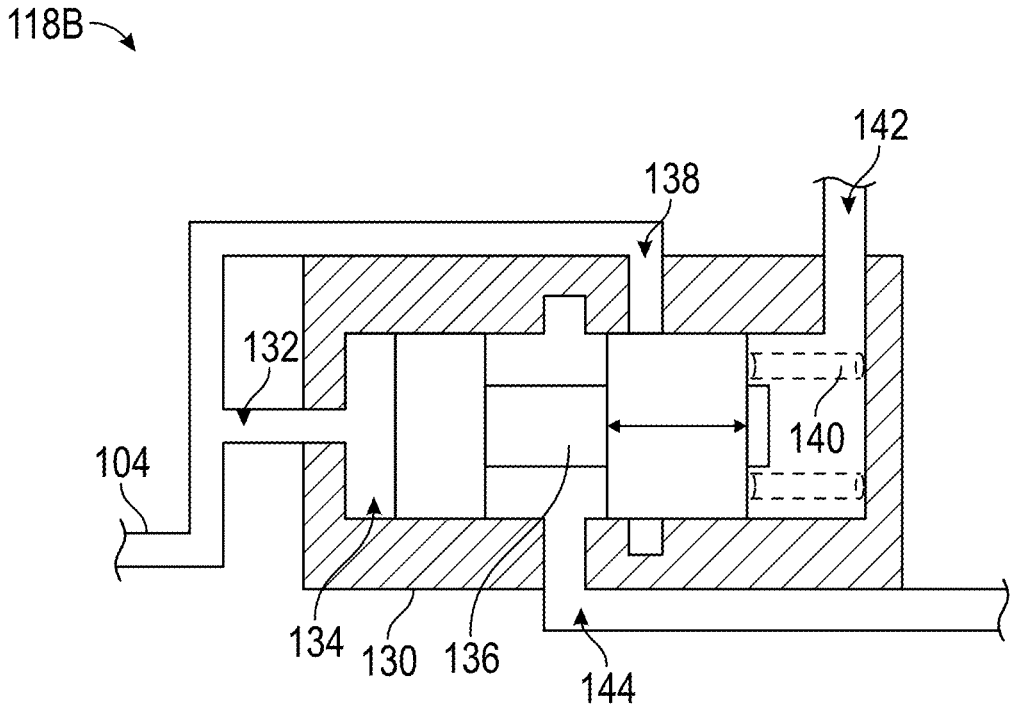
FIG. 5 is a schematic illustration of another example of the first valve assembly of FIG. 2.

FIG. 5 is a schematic illustration of a second valve type 118B for use as the first valve assembly 118. In the illustrated example, the second valve type 118B is a spring actuated pressure relief valve, such as a spool valve. The second valve type 118B includes a body portion 130 having a first inlet 132 in fluid communication with the outlet 104 and a second inlet 138 in fluid communication with the outlet 104. The first inlet 132 feeds a chamber 134 that is biased against a spring 140 in a chamber having a spring relieve outlet 142. The biasing force from the spring 140 against the valve body 136 prevents lubricant from passing through the second valve type 118B from the second inlet 138 to an outlet 144. The outlet 144 feeds the lubricant to the rotor lubrication circuit 106 through the rotor lubrication circuit orifice 120 as shown in FIG. 2. In the illustrated example, once the pressure at the outlet 104 reaches the pressure P1, the pressure of the lubricant in the chamber 134 is sufficient to overcome the biasing force of the spring 140 to allow the lubricant to flow through the second valve type 118B to the outlet 144.

Figure 6:
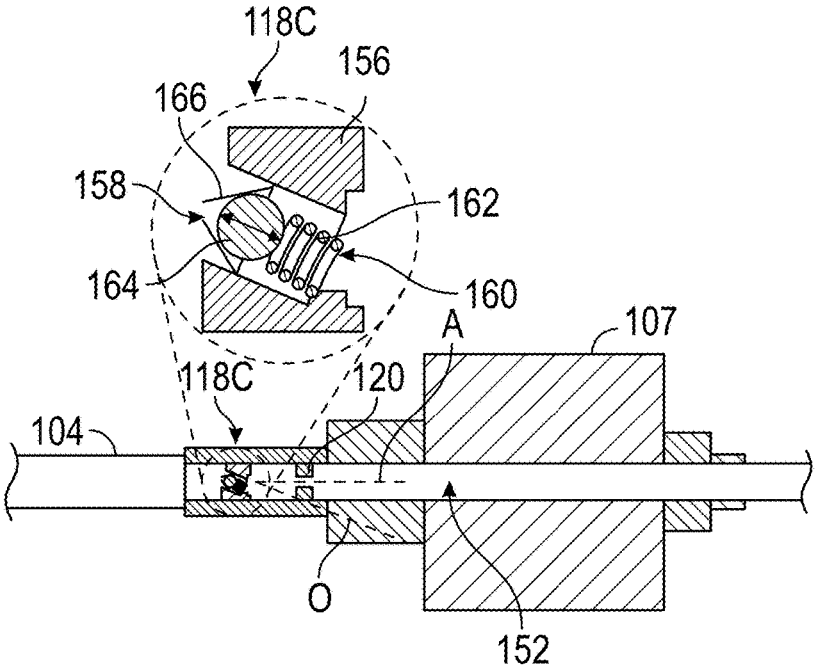
FIG. 6 is a schematic illustration of yet another example first valve assembly of FIG. 2.

FIG. 6 is a schematic illustration of a third valve type 118C for use as the first valve assembly 118. In the illustrated example, the third valve type 118C is an off-axis ball valve. One feature of the off-axis ball valve is that it limits a flowrate of lubricant through the rotor lubrication circuit 106 based on at least one of the pressure of the lubricant at the outlet 104 of the heat exchanger 102 or a rotational speed of the rotor 107 of the motor M shown in FIG. 1.

As shown in FIG. 6, the rotor 107 of the motor M rotates about a central longitudinal axis A and includes an internal lubricant passage 152 at least partially defined by the rotor 107 that is in fluid communication with the outlet 104 of the heat exchanger 102. The third valve type 118C is located within the internal lubricant passage 152 and is configured to rotate with the rotor 107. The third valve type 118C includes a circumferential frame 156 having a radially outer surface that engages a radially inner surface of the internal lubricant passage 152 and a radially inner surface that at least partially defines an internal passage through the third valve type 118C. The internal passage includes a housing 166 defining an inlet 158 at a first end and an outlet 160 at a second end. A ball 164 is configured to move in the direction of the arrows depending on fluid pressure and rotational speed of the rotor 107. The direction of the arrows is off or transverse to the axis of rotation of the rotor 107. A spring 162 bias the ball 164 towards the inlet 158 such that the spring 162 can seat against the housing 166 and seal the inlet 158. Additionally, a direction of the arrows extends along an axis O that is off or transverse to the axis of rotation A of the rotor 107.

During operation of the lubrication system 100, the third valve type 118C can limit the flow of lubricant when a rotational speed of the rotor 107 is sufficiently high to overcome a force on the ball 164 caused by a pressure at the outlet 104 of the heat exchanger 102. Because the ball 164 moves along the axis O, the rotational speed of the rotor 107 applies a centrifugal force on the ball 164 that pushes the ball 164 radially outward in addition to the force being applied by the spring 162. For example, even though the pressure at the outlet 104 may be sufficient to overcome a biasing force from a spring 162, the centrifugal forces on the ball 164 caused by the rotation of the rotor 107 may cause the third valve type 118C to close. In particular, this situation can occur when the load on the motor M is low enough that the pressure of the lubricant at the outlet 144 is insufficient to overcome the combined centrifugal forces and spring biasing forces. However, when a load on the motor M increases to a predetermined level requiring additional cooling, the pump 116 increases the pressure at the outlet 104 such that the combined spring and centrifugal forces can be overcome.

Figure 7:
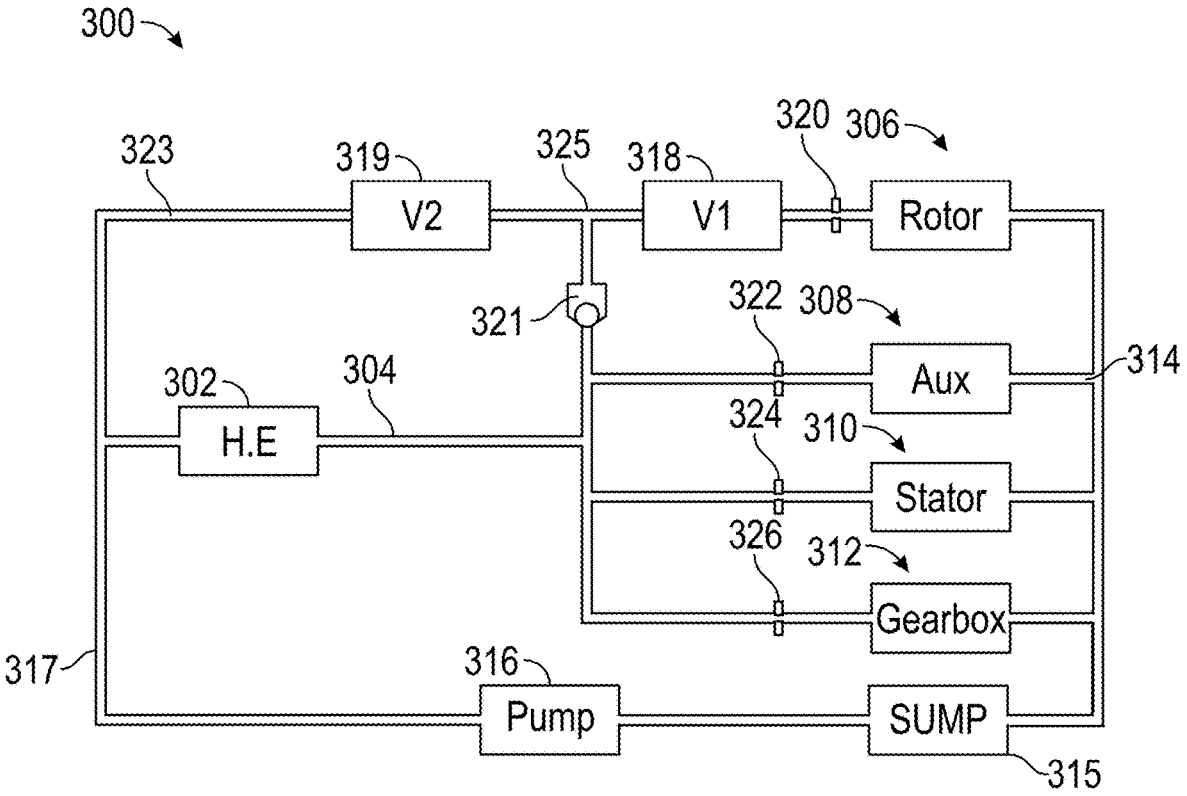
FIG. 7 is a schematic illustration of another example lubrication system for the vehicle of FIG. 1 having multiple lubrication circuits.

FIG. 7 illustrates another example lubrication system 300. The lubrication system 300 is similar to the lubrication system 100 except where described below or shown in the drawings. Similar or identical components between the lubrication system 300 and the lubrication system 100 will include a leading "3" in place of the leading "1." One feature of the lubrication system 300 compared to the lubrication system 100 is the ability to direct lubricant around or bypass the heat exchanger to feed the rotor lubrication circuit during certain operating conditions.

In the illustrated example, the lubrication system 300 includes a fluid outlet 304 that delivers a cooled lubricant to a rotor lubrication circuit 306 of the motor M, an auxiliary lubrication circuit 308, such as a heater core or battery, a stator lubrication circuit 310 of the motor M, or a gearbox lubrication circuit 312 for the gearbox GB through a respective rotor lubrication circuit, auxiliary lubrication circuit, stator lubrication circuit, or gearbox lubrication circuit. A pump 316 circulates the lubricant from a sump 315 that collects the lubricant from an exhaust 314 of each of the lubrication circuits having a lower pressure than an inlet 317 to the heat exchanger 302 from the pump 316. In the illustrated example, the pump 316 can include a mechanically driven pump or an electrically driven pump having a variable output flowrate.

In the illustrated example, the auxiliary lubrication circuit, the stator lubrication circuit, and the gearbox lubrication circuit are passively managed with an auxiliary lubrication circuit orifice 322, a stator lubrication circuit orifice 324, and a gearbox lubrication circuit orifice 326, respectively.

Furthermore, while the rotor lubrication circuit also includes a rotor lubrication circuit orifice 320, the rotor lubrication circuit also includes a first valve assembly 318 and a floating ball valve 321. A second valve assembly 319, such as a bypass mechanical valve, is fluidly connected to the rotor lubrication circuit between the first valve assembly 318 and the floating ball valve 321 at a bypass connection 325. In the illustrated example, the first valve assembly 318, the floating ball valve 321, and the second valve assembly 319 are mechanically actuated based on conditions of the lubrication system 300, such that valves the do not include an electrical actuator. In the illustrated example, the first valve assembly 318 can include one of the first, second, or third valve types 118A, 118B, or 118C described above. The floating ball valve 321 functions in a vertical orientation and utilizes the force of gravity on a ball to prevent lubricant from the outlet 104 of the heat exchanger from passing into the rotor lubrication circuit.

In the illustrated example, the second valve assembly 319 can include a piston type or spool valve like the second valve type 118B as discussed above. Utilizing the first valve assembly 318, the second valve assembly 319, and the floating ball valve 321, the lubrication system 300 can restrict lubricant flow to the rotor lubrication circuit 306, direct lubricant that has bypassed the heat exchanger 302, or direct lubricant that has passed through the heat exchanger 302 based on the operating pressure of the lubricant at the outlet 304 of the heat exchanger 302.

In particular, the first valve assembly 318 remains closed until the pressure upstream of the first valve assembly 318 reaches the cracking pressure P1. The second valve assembly 319 remains open until the pressure P2, such as a bypass closing pressure, at the second valve assembly 319 is reached. Therefore, between the pressures P1 and P2, the lubricant bypasses the heat exchanger 302 when going to the rotor lubrication circuit 306. When the pressure at the second valve assembly 319 reaches P2, the second valve assembly 319 moves from the open position to the closed position. When the second valve assembly 319 closes, it causes a pressure drop in the rotor circuit that causes the floating ball valve 321 to move from the closed position to the open position to allow cooled lubricant from the heat exchanger 302 to flow into the rotor lubrication circuit 306.

Figure 8:
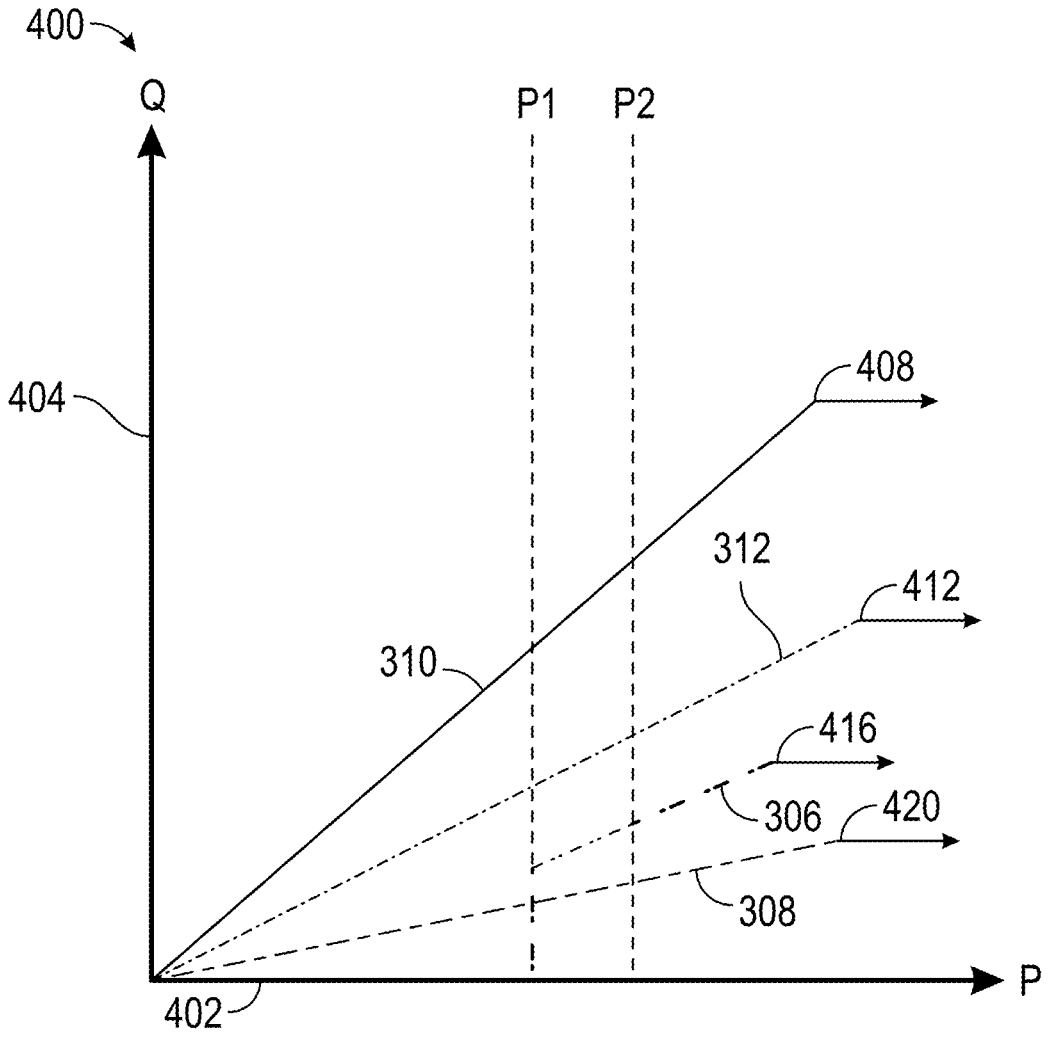
FIG. 8 is a schematic illustration of lubrication flow rates in each of the lubrication circuits of FIG. 7 at varying levels of pressure in the lubrication system.

FIG. 8 is a graphical illustration 400 showing how the flow rate ("Q") along the y-axis 404 varies for each circuit as pressure ("P") along the x-axis 402 at the outlet of the heat exchanger 302 varies. For the stator lubrication circuit 310, the flowrate Q increases with pressure P until a point 408 where a maximum flowrate determined by the stator lubrication circuit orifice 324 is reached. For the gearbox lubrication circuit 312, the flowrate Q increases with pressure P until a point 412 where a maximum flowrate determined by the gearbox lubrication circuit orifice 326 is reached. For the auxiliary lubrication circuit 308, the flowrate increases Q with pressure P until a point 420 where a maximum flowrate determined by the auxiliary lubrication circuit orifice 322 is reached.

Unlike the other lubrication circuits, the rotor lubrication circuit 306 can restrict the flowrate Q of lubricant until a pressure P1 upstream of the first valve assembly 318 is reached. One feature of restricting the flowrate Q in the rotor lubrication circuit 306 below the pressure P1, is that a rotor core temperature is allowed to increase while a load on the motor M results in the pressure at the outlet of the heat exchanger 302 being below P1. The increase in temperature of the rotor core can increase efficiency of the motor M when the load is below a predetermined load threshold and a rotational speed is above a predetermined rotational threshold as discussed above. As shown in FIG. 8, the first valve assembly 318 restricts the flowrate Q of lubricant into the rotor lubrication circuit 306 until the pressure P1 is reached. Once the pressure P1 is reached, the flowrate Q increases until a point 416 where a maximum flowrate Q determined by the rotor lubrication circuit orifice 320 is reached.

As shown in FIG. 8, when a pressure upstream of the first valve assembly 318 is less than the pressure P1, no lubricant will reach in the rotor lubrication circuit 306. In the illustrated example, the pressure P1 corresponds to the cracking pressure of the first valve assembly 318.

While a pressure at the second valve assembly 319 remains between the pressure P1 and the pressure P2, the lubricant bypasses the heat exchanger 302 through a heat exchanger bypass passage 323 and travels through both the first and second valve assemblies 318 and 319 to reach the rotor lubrication circuit 306. While in this pressure range, the floating ball valve 321 remains closed and only lubricant that has bypassed the heat exchanger 302 enters the rotor lubrication circuit 306. However, the auxiliary lubrication circuit 308, the stator lubrication circuit 310, and the gearbox lubrication circuit 312 continue to receive lubricant that has passed through the heat exchanger 302 from the outlet 304.

When the pressure of the lubricant at the second valve assembly 319 reaches the pressure P2, the second valve assembly 319 moves from an open position to a closed position to block the flow of bypassed lubricant from the heat exchanger bypass passage 323 to the rotor lubrication circuit 306. Also, when the pressure P2 is reached, a floating ball valve cracking pressure for the floating ball valve 321 is reached such that the floating ball valve 321 moves from a closed position to an open position to allow lubricant from the outlet 304 of the heat exchanger 302 to reach the rotor lubrication circuit 306. The floating ball valve 321 moves to the open position due to the pressure drop in the rotor lubrication circuit when the second valve assembly 319 closes.

Figure 9:
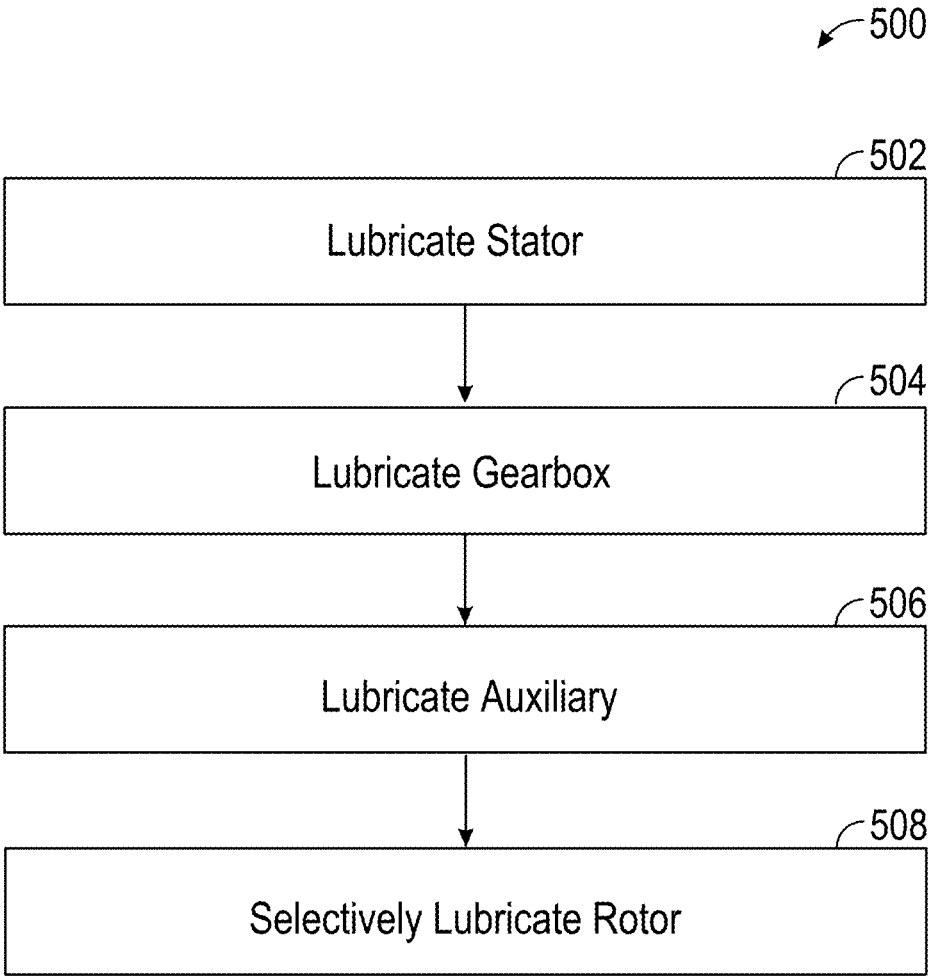
FIG. 9 illustrates a flow diagram of an example method of operating one of the lubrication circuits of FIG. 2 or FIG. 7.

FIG. 9 illustrates a flowchart of an example method 500 of operating one of the lubrication systems 100 or 300. The method 500 begins at block 502 by directing lubricant to the stator in the motor M through the stator lubrication circuit. The flowrate Q of the lubricant to the stator is dependent on the stator lubrication circuit orifice 124, 324. The method 500 then directs lubricant to the gearbox GB through the gearbox lubrication circuit 112, 312 at block 504. The flowrate Q of the lubricant to the gearbox GB is dependent on the gearbox lubrication circuit orifice 126, 326. The method 500 then directs lubrication to the auxiliary lubrication circuit 108 or 308 at block 506. The flowrate Q of the lubricant to the auxiliary lubrication circuit 108 or 308 is dependent on the orifices 124 or 324. The method 500 then proceeds to block 508.

At block 508, the method selectively directs lubricant to the rotor lubrication circuit 106, 306 in the rotor lubrication circuit. As discussed above, the rotor lubrication circuit does not allow lubricant to reach the rotor lubrication circuit 106, 306 until a cracking pressure of the first valve assembly 118, 318 is reached. In the case of the lubrication system 100, the lubricant that reaches the rotor lubrication circuit 106 has passed through the heat exchanger 102. However, the lubricant that reaches the rotor lubrication circuit 306 in the lubrication system 300 may either has bypassed the heat exchanger 302 or passed through the heat exchanger depending on a pressure of the lubricant at an outlet of the heat exchanger 302.

The terms "a" and "an" do not denote a limitation of quantity, but rather denote the presence of at least one of the referenced items. The term "or" means "and/or" unless clearly indicated otherwise by context. Reference throughout the specification to "an aspect", means that a particular element (e.g., feature, structure, step, or characteristic) described in connection with the aspect is included in at least one aspect described herein, and may or may not be present in other aspects. In addition, it is to be understood that the described elements may be combined in a suitable manner in the various aspects.

While the above disclosure has been described with reference to exemplary embodiments, it will be understood by those skilled in the art that various changes may be made, and equivalents may be substituted for elements thereof without departing from its scope. In addition, many modifications may be made to adapt a particular situation or material to the teachings of the disclosure without departing from the scope thereof. Therefore, it is intended that the present disclosure not be limited to the particular embodiments disclosed but will include embodiments falling within the scope thereof.

The invention claimed is:

1. A lubrication system for a vehicle, comprising:

a heat exchanger having an inlet and an outlet;

a gearbox lubrication circuit fluidly connecting a gearbox between the inlet and the outlet of the heat exchanger;

a stator lubrication circuit fluidly connecting a stator between the inlet and the outlet of the heat exchanger;

a rotor lubrication circuit fluidly connecting a rotor between the inlet and the outlet of the heat exchanger, wherein the rotor lubrication circuit includes a rotor circuit mechanical valve located upstream of an inlet to the rotor and downstream of the outlet of the heat exchanger and the rotor circuit mechanical valve is configured to move from a closed position to an open position when a pressure immediately upstream of the rotor circuit mechanical valve reaches a rotor circuit mechanical valve cracking pressure; and a heat exchanger bypass passage configured to bypass the inlet to the heat exchanger and connect with the rotor lubrication circuit downstream of the outlet of the heat exchanger, wherein the heat exchanger bypass passage includes a bypass mechanical valve upstream of the rotor circuit mechanical valve and the bypass mechanical valve includes a cracking pressure to move from an open position to a closed position that is greater than the cracking pressure of the rotor circuit mechanical valve.

2. The lubrication system of claim 1, wherein the rotor circuit mechanical valve includes one of a spring actuated ball valve or a spring actuated pressure relief valve.

3. The lubrication system of claim 1, wherein the rotor circuit mechanical valve includes an off-axis ball valve configured to move from the closed position to an open position allowing lubricant to flow to the rotor when a pressure in the rotor lubrication circuit exceeds the rotor circuit mechanical valve cracking pressure.

4. The lubrication system of claim 1, wherein the rotor circuit mechanical valve includes an off-axis ball valve configured to move from an open position to a closed position when a centrifugal force on a ball in the off-axis ball valve caused by rotation of the rotor is greater than the pressure immediately upstream of the rotor circuit mechanical valve.

5. The lubrication system of claim 1, wherein the rotor lubrication circuit includes a floating ball valve upstream of the rotor circuit mechanical valve and the bypass connection.

6. The lubrication system of claim 5, wherein the floating ball valve includes a floating ball valve cracking pressure that is less than bypass closing pressure of the bypass mechanical valve.

7. The lubrication system of claim 1, wherein the gearbox lubrication circuit, the stator lubrication circuit, and the rotor lubrication circuit are connected fluidly in parallel with an auxiliary lubrication circuit between the outlet of the heat exchanger and a sump.

8. The lubrication system of claim 1, wherein the stator lubrication circuit includes a stator orifice having a stator lubrication circuit maximum flow rate, the gearbox lubrication circuit includes a gearbox orifice having a gearbox lubrication circuit maximum flow rate, and the rotor lubrication circuit includes a rotor orifice having a rotor lubrication circuit maximum flow rate.

9. The lubrication system of claim 8, wherein the rotor orifice is located downstream of the rotor circuit mechanical valve.

10. The lubrication system of claim 1, including an electrically driven pump having a variable output flowrate configured to direct lubricant from the gearbox lubrication circuit, the stator lubrication circuit, and the rotor lubrication circuit to an output of the electrically driven pump.

11. A method of operating a lubrication system, the method comprising:

directing a lubricant from an outlet of a heat exchanger to a stator lubrication circuit;

directing the lubricant from the outlet of the heat exchanger to a gearbox lubrication circuit;

selectively directing the lubricant to a rotor lubrication circuit, wherein the rotor lubrication circuit includes a rotor circuit mechanical valve upstream of a rotor and is configured to block a flow of the lubricant to the rotor when a pressure of the lubricant immediately upstream of the rotor circuit mechanical valve is less than a cracking pressure of the rotor circuit mechanical valve and the rotor circuit mechanical valve is configured open when the pressure of the lubricant immediately upstream of the rotor circuit mechanical valve is greater than the cracking pressure of the rotor circuit mechanical valve; and bypassing lubricant around the heat exchanger with a heat exchanger bypass passage forming a connection to the rotor lubrication circuit, wherein the heat exchanger bypass passage includes a bypass mechanical valve located upstream of the rotor circuit mechanical valve and the bypass mechanical valve includes a cracking pressure to move from an open position to a closed position that is greater than the cracking pressure of the rotor circuit mechanical valve.

12. The method of claim 11, including directing the lubricant through the lubrication system with an electrically driven pump having variable output flowrate.

13. The method of claim 11, including opening a floating ball valve located downstream of an outlet of the heat exchanger and upstream of the connection with the heat exchanger bypass passage at the cracking pressure of the bypass mechanical valve.

14. The method of claim 11, wherein the rotor circuit mechanical valve includes one of a spring actuated ball valve or a spring actuated pressure relief valve.

15. The method of claim 11, wherein the rotor circuit mechanical valve includes an off-axis ball valve configured to move from the closed position to an open position allowing lubricant to flow to the rotor when a pressure in the rotor lubrication circuit exceeds the rotor circuit mechanical valve cracking pressure.

16. A vehicle comprising:

a passenger compartment;

a plurality of wheels supporting the passenger compartment;

a traction motor having a rotor and a stator with the rotor configured to drive at least one of the plurality of wheels through a gearbox; and a lubrication system including:

a heat exchanger having an inlet and an outlet;

a gearbox lubrication circuit fluidly connecting a gearbox between the inlet and the outlet of the heat exchanger;

a stator lubrication circuit fluidly connecting a stator between the inlet and the outlet of the heat exchanger;

a rotor lubrication circuit fluidly connecting a rotor between the inlet and the outlet of the heat exchanger, wherein the rotor lubrication circuit includes a rotor circuit mechanical valve located upstream of an inlet to the rotor and downstream of the outlet of the heat exchanger and the rotor circuit mechanical valve is configured to move from a closed position to an open position when a pressure immediately upstream of the rotor circuit mechanical valve reaches a rotor circuit mechanical valve cracking pressure; and a heat exchanger bypass passage configured to bypass the inlet to the heat exchanger and connect with the rotor lubrication circuit downstream of the outlet of the heat exchanger, wherein the heat exchanger bypass passage includes a bypass mechanical valve upstream of the rotor circuit mechanical valve and the bypass mechanical valve includes a cracking pressure to move from an open position to a closed position that is greater than the cracking pressure of the rotor circuit mechanical valve.

17. The vehicle of claim 16, wherein the rotor circuit mechanical valve includes an off-axis ball valve configured to move from the closed position to an open position allowing lubricant to flow to the rotor when a pressure in the rotor lubrication circuit exceeds the rotor circuit mechanical valve cracking pressure.

18. The vehicle of claim 16, wherein the rotor lubrication circuit includes a floating ball valve upstream of the rotor circuit mechanical valve and the bypass connection and the floating ball valve includes a floating ball valve cracking pressure that is less than a bypass closing pressure of the bypass mechanical valve.

19. The vehicle of claim 16, wherein the gearbox lubrication circuit, the stator lubrication circuit, and the rotor lubrication circuit are connected fluidly in parallel with an auxiliary lubrication circuit between the outlet of the heat exchanger and a sump.

20. The vehicle of claim 16, wherein the stator lubrication circuit includes a stator orifice having a stator lubrication circuit maximum flow rate, the gearbox lubrication circuit includes a gearbox orifice having a gearbox lubrication circuit maximum flow rate, and the rotor lubrication circuit includes a rotor orifice having a rotor lubrication circuit maximum flow rate.

* * * * *